US007958572B2

(12) United States Patent
Loury et al.

(10) Patent No.: US 7,958,572 B2
(45) Date of Patent: Jun. 14, 2011

(54) FOLDABLE PROTECTIVE HELMET

(75) Inventors: Paul Loury, Coublevie (FR); Pascal Joubert Des Ouches, Coublevie (FR)

(73) Assignee: PJDO, Voiron (FR)

( * ) Notice: Subject to any disclaimer, the term of this patent is extended or adjusted under 35 U.S.C. 154(b) by 223 days.

(21) Appl. No.: 12/097,581

(22) PCT Filed: Dec. 7, 2006

(86) PCT No.: PCT/FR2006/051301

§ 371 (c)(1),
(2), (4) Date: Jun. 16, 2008

(87) PCT Pub. No.: WO2007/068846

PCT Pub. Date: Jun. 21, 2007

(65) Prior Publication Data

US 2009/0222976 A1 Sep. 10, 2009

(30) Foreign Application Priority Data

Dec. 15, 2005 (FR) ..... 05 53883

(51) Int. Cl.

| | |
|---|---|
| ***A42B 1/06*** | (2006.01) |
| ***A42B 3/00*** | (2006.01) |
| ***A42B 1/22*** | (2006.01) |
| ***A63B 71/10*** | (2006.01) |

(52) U.S. Cl. ..... 2/410; 2/411; 2/414; 2/417; 2/420; 2/425

(58) Field of Classification Search ..... 2/410, 6.1, 2/6.6, 411, 412, 413, 414, 415, 416, 417, 2/418, 419, 420, 421, 422, 423, 424, 425, 2/171.03, 171.1, 171.4, 171.5, 171.6, 171.7, 181.4; D29/102, 106, 108
See application file for complete search history.

(56) References Cited

U.S. PATENT DOCUMENTS

| | | | | |
|---|---|---|---|---|
| 1,364,662 | A * | 1/1921 | Wagner | 2/410 |
| 2,765,472 | A * | 10/1956 | Schoen-Wolski | 2/195.1 |
| 2,861,273 | A * | 11/1958 | Stuart et al. | 2/6.7 |
| 2,861,274 | A * | 11/1958 | Stuart et al. | 2/6.7 |

(Continued)

FOREIGN PATENT DOCUMENTS

| | | |
|---|---|---|
| DE | 202004012285 | 9/2004 |

(Continued)

OTHER PUBLICATIONS

International Search Report PCT/FR2006/051301 dated May 15, 2007.

*Primary Examiner* — Shaun R Hurley
*Assistant Examiner* — Jane S Yoon
(74) *Attorney, Agent, or Firm* — Burr & Brown

(57) ABSTRACT

This protective helmet comprises a rigid or semi-rigid external shell comprising a plurality of rigid or semi-rigid flaps joined together and a compressively deformable internal liner acting as a shock absorber, the latter also comprising several elements associated with said flaps.

At least some of the flaps that constitute the external shell are capable of moving relative to each other at their respective means of connection and the elements that constitute the internal liner associated with the flaps in question are designed so that they retract inside the volume defined by the helmet during relative displacement of the corresponding flaps.

21 Claims, 11 Drawing Sheets

U.S. PATENT DOCUMENTS

| | | | | | |
|---|---|---|---|---|---|
| 2,866,978 | A | * | 1/1959 | Stuart et al. | 2/6.7 |
| 2,888,681 | A | * | 6/1959 | Stuart et al. | 2/6.6 |
| 2,889,555 | A | * | 6/1959 | Stuart et al. | 2/6.6 |
| 3,230,544 | A | * | 1/1966 | Mager | 2/415 |
| 3,353,188 | A | * | 11/1967 | Crincic | 2/416 |
| 3,502,074 | A | * | 3/1970 | Jones et al. | 128/202.11 |
| 3,514,787 | A | * | 6/1970 | Kennedy, Jr. | 2/410 |
| 3,991,422 | A | * | 11/1976 | Saotome | 2/410 |
| 4,477,929 | A | * | 10/1984 | Mattsson | 2/425 |
| 4,587,676 | A | * | 5/1986 | Estadella | 2/424 |
| 4,607,397 | A | * | 8/1986 | Laxo | 2/410 |
| 4,766,615 | A | * | 8/1988 | Morin et al. | 2/421 |
| 4,827,537 | A | * | 5/1989 | Villa | 2/410 |
| 5,056,156 | A | * | 10/1991 | Kosmo et al. | 2/411 |
| 5,116,288 | A | * | 5/1992 | Kondo et al. | 2/171 |
| 5,448,780 | A | * | 9/1995 | Gath | 2/424 |
| 5,604,935 | A | * | 2/1997 | Nezer | 2/410 |
| 5,628,071 | A | * | 5/1997 | Nezer | 2/410 |
| 6,209,139 | B1 | * | 4/2001 | Schmidt et al. | 2/171.1 |
| 6,442,765 | B1 | | 9/2002 | Fallon et al. | |
| 2002/0007508 | A1 | * | 1/2002 | Grepper et al. | 2/420 |
| 2002/0023290 | A1 | * | 2/2002 | Watters et al. | 2/410 |
| 2002/0035748 | A1 | * | 3/2002 | Racine | 2/414 |
| 2004/0045078 | A1 | * | 3/2004 | Puchalski | 2/411 |
| 2004/0172739 | A1 | * | 9/2004 | Racine | 2/417 |
| 2004/0255369 | A1 | * | 12/2004 | Puchalski | 2/410 |
| 2005/0034222 | A1 | | 2/2005 | Durocher | |
| 2005/0257312 | A1 | * | 11/2005 | Puchalski | 2/411 |

FOREIGN PATENT DOCUMENTS

| | | | | |
|---|---|---|---|---|
| EP | 0150876 | | | 8/1985 |
| EP | 0279086 | | | 8/1988 |
| EP | 2781650 | | | 2/2000 |
| FR | 2781650 | | | 2/2000 |
| FR | 2865356 | | | 7/2005 |
| JP | 06192906 | A | * | 7/1994 |
| JP | 06192907 | A | * | 7/1994 |
| JP | 08325824 | A | * | 12/1996 |
| JP | 2000192320 | A | * | 7/2000 |
| JP | 2004084145 | A | * | 3/2004 |
| JP | 2004360152 | A | * | 12/2004 |

* cited by examiner

FIG. 19a
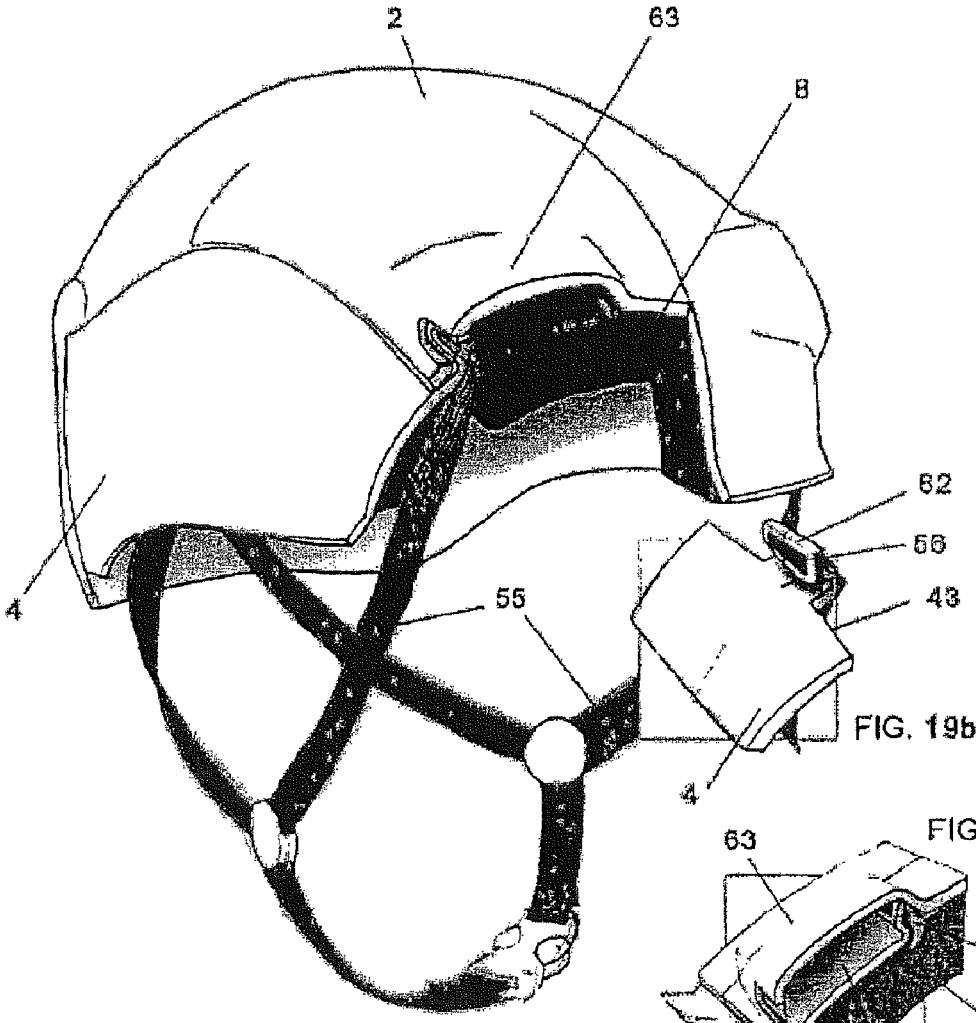
FIG. 19b
FIG. 19c
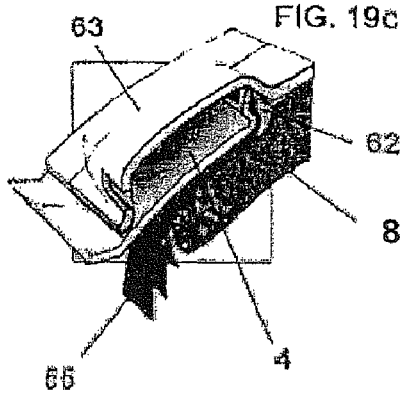

FOLDABLE PROTECTIVE HELMET

FIELD OF THE INVENTION

The invention relates to a protective helmet, more especially a helmet intended for taking part in sporting activities of the mountain climbing, cycling, mountain biking, skiing, etc. type and, generally speaking, taking part in activities where the desired level of protection is equivalent to that required in areas as varied as sport, leisure, transport (motorbike, bicycle, etc.) and industry.

BACKGROUND

Against the background of heightened safety consciousness in sporting activities in particular, people are increasingly being advised to wear a helmet in order to at least reduce, if not eliminate, the consequences of a fall or impact.

This is true in particular in the field of mountain climbing and skiing but also for cycling and more especially mountain biking and even road cycling.

One of the main requirements that users of these helmets demand is the possibility of combining a certain degree of mechanical strength with reduced overall dimensions and, above all, reduced weight.

Protective helmets comprising a rigid or semi-rigid external shell associated with a separate compressively deformable element fitted inside the shell and intended to absorb shocks caused by possible falls have been proposed in order to meet this demand. Such a shock absorbing element is also referred to as a shock absorbing liner.

Such a helmet is described, for example, in document FR 2 865 356. The helmet that is the subject of this document consists of a plurality of external rigid flaps linked to each other by means of connecting elements made of a flexible material that ensures connection of the flaps and define a rear so-called occipital flap and a plurality of lateral transversal flaps, the totality of these flaps therefore defining the shell that encloses the internal shock absorbing liner.

Although the helmet described is satisfactory in terms of its primary objectives, namely protection and flexibility, it nevertheless has the drawback of being relatively bulky because of the space that it takes up.

Given the fact that such a helmet is not worn at all times by the user, for example when taking a break, when walking the approach to a mountain, during transfers using ski lifts or, in the case of a cyclist, when the latter is on the move, especially in a town, and parks his or her bike etc., it is desirable to produce a helmet that has compact overall dimensions when it is not in use.

To achieve this, document FR 2 781 650, for example, proposes a folding protective helmet, the shell of which consists of individual articulated segments joined together on their front and rear end, thus making it possible to deploy or fold said shell at will, depending whether or not the helmet is in use.

Nevertheless, this protective helmet does not use an internal shock absorbing liner but an inflatable structure that cannot effectively fulfil a shock absorbing function and the protection actually provided by such a helmet is poor and unsatisfactory to users in any case.

The present invention therefore relates to a protective helmet of the type in question which ensures both effective protection by using a rigid or semi-rigid shell and a shock absorbing internal liner but nevertheless makes it possible to fold or reduce the size of the helmet, notwithstanding the presence of said shock absorbing element.

SUMMARY OF THE INVENTION

The invention therefore relates to a protective helmet comprising a rigid or semi-rigid external shell consisting of a plurality of rigid or semi-rigid flaps joined together and an internal liner acting as a shock absorber, the latter consisting of several elements associated with said flaps, including at least one central element and one or more peripheral elements.

According to the invention:

at least some of the flaps that constitute the external shell are capable of moving relative to each other at their respective means of connection, only the peripheral elements that constitute the internal liner associated with the corresponding flaps are designed so that they retract inside the volume defined by the helmet and by the central element during relative displacement of the corresponding flaps.

This being so, it becomes possible to reduce the overall dimensions of the helmet when it is not in its operational protective position by ensuring relative displacement of some of the flaps relative to each other, this displacement not being affected or being only slightly affected by the presence of the elements that constitute the internal liner.

According to one aspect of the invention, the rigid or semi-rigid external shell comprises an upper flap defining a crown and two lateral flaps, referred to subsequently in this description as "elytra", that are articulated on the crown, advantageously in the anterior or even in the posterior area.

In this configuration, the shock absorbing element associated with the crown defines, together with the latter, an empty space into which the elytra are capable of sliding by rotation at the point(s) where they are articulated on the crown.

Still in this configuration, the shock absorbing element associated with the crown defines, at the level of its lateral extensions, a plurality of notches oriented substantially parallel to each other into which substantially matching protrusions constituting part of the shock absorbing element associated with each of the elytra are capable of sliding or engaging.

According to one version of this configuration, the shock absorbing element associated with the crown defines, at the level of its lateral extensions, a thinned area onto which the shock absorbing element associated with each of the elytra and having a continuous profile is capable of engaging.

According to one version of the invention, the shock absorbing elements associated with the elytra are not physically attached to them. Thus, they are articulated on the shock absorbing element associated with the crown and, consequently, are reversibly attached to said elytra in the deployed position, for example by means of a hook-and-loop type tape. When one wishes to fold the helmet, one thus detaches the corresponding shock absorbing elements from the elytra which can then slide into the space defined between the crown and the shock absorbing element associated with it and, consequently, one folds up the shock absorbing elements associated with said elytra into the helmet by simply rotating them around their articulation axis onto the shock absorbing element of the crown.

According to another version of a similar kind, the shock absorbing element associated with each of the elytra is only permanently connected to the latter by means of a flexible hinge on the base of said elytron and the element associated with it respectively. In addition, as in the previous version, said element is reversibly attached to the elytron in the deployed position by means of a hook-and-loop system. This being so, when one wishes to fold the helmet, one detaches the shock absorbing elements from the elytra and while sliding the elytra into the space defined between the crown and the shock absorbing element associated with it, one causes displacement of the shock absorbing elements associated with them, substantially parallel to the shock absorbing element of the crown.

Advantageously, the protective helmet in accordance with the invention also comprises a rear or occipital flap on its external shell.

This rear flap can be articulated on the crown and can be folded up inside the latter by a simple rotation movement. This occipital element advantageously comprises a deformable element capable of providing both comfort and shock absorption.

This rear flap is also capable of sliding into the space defined between the crown and the shock absorbing element associated with it, in the same way as the elytra.

The helmet in accordance with the invention also advantageously comprises a head size adjustment system, conventionally referred to as a "fit system".

BRIEF DESCRIPTION OF THE DRAWINGS

The way in which the invention may be implemented and its resulting advantages will be made more readily understandable by the description of the following embodiment, given merely by way of example, reference being made to the accompanying drawings.

FIGS. 19*a*, 19*b* and 19*c* are schematic views of a third method of fastening the anterior attachment straps of the helmet to the user's head.

DETAILED DESCRIPTION

Figure 1:
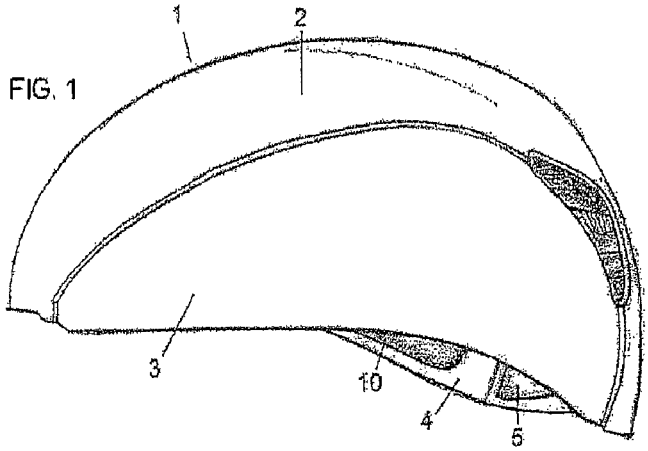
FIG. 1 is a schematic perspective view of the helmet in accordance with the invention in its operational configuration when in use, viewed from the side.

FIG. 1 therefore shows a side view of the protective helmet in accordance with the invention in its operational configuration, i.e. when deployed.

In this particular embodiment of the invention, the helmet comprises an external shell which, in this case, consists of four elements or flaps made of a rigid material, typically polycarbonate, polyamide, Acrylonitrile Butadiene Styrene (ABS) or even a composite material. These flaps are made using any known industrial process for processing plastics, especially injection moulding, thermoforming or drawing.

These four elements consist respectively of an upper element (2) called the crown (2) two lateral flaps or elytra (3, 4) that extend substantially the entire length of the helmet and a rear element (5) that acts as an occipital protective element.

These various flaps are connected to each other as described below.

Figure 2:
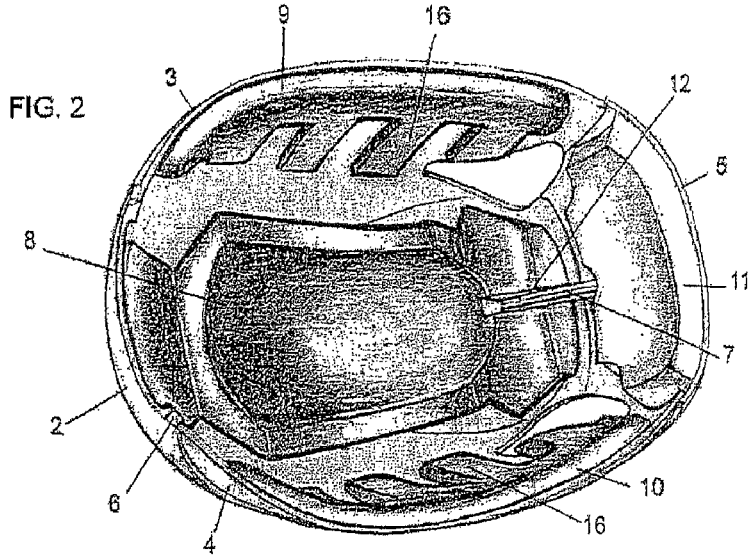
FIG. 2 is a bottom view of the helmet in question, also in its operational configuration.
Figure 6:
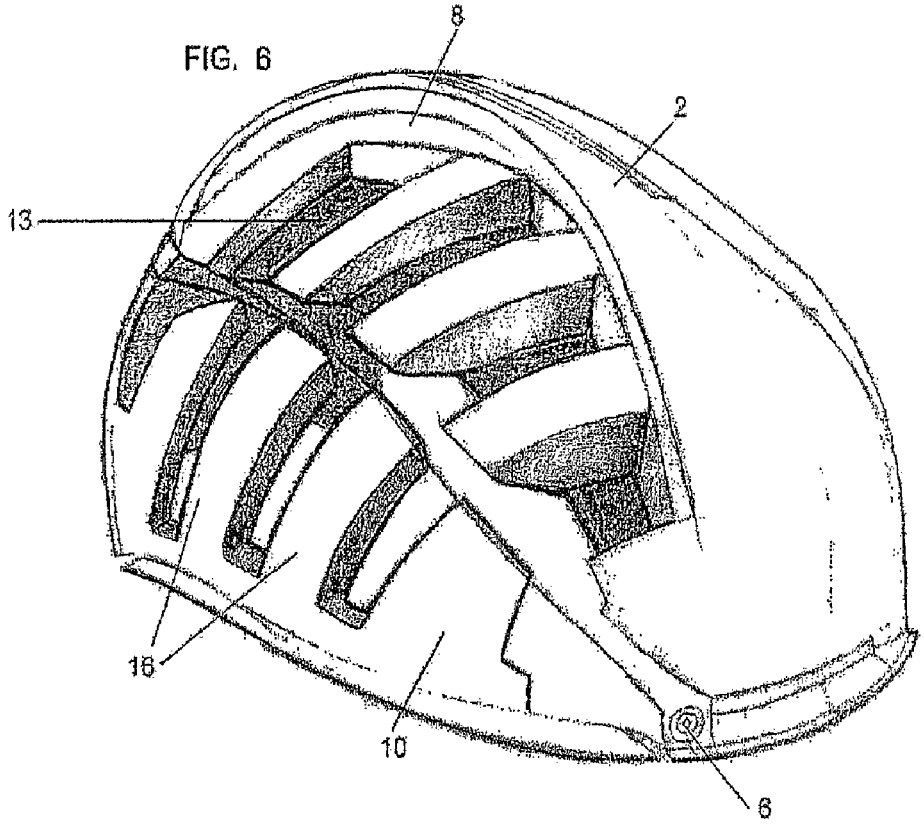
FIGS. 6 and 7 schematically show a perspective view of two configurations of the helmet, a first configuration of the helmet in deployed operational mode and a second configuration of the helmet when it is being folded.
Figure 7:
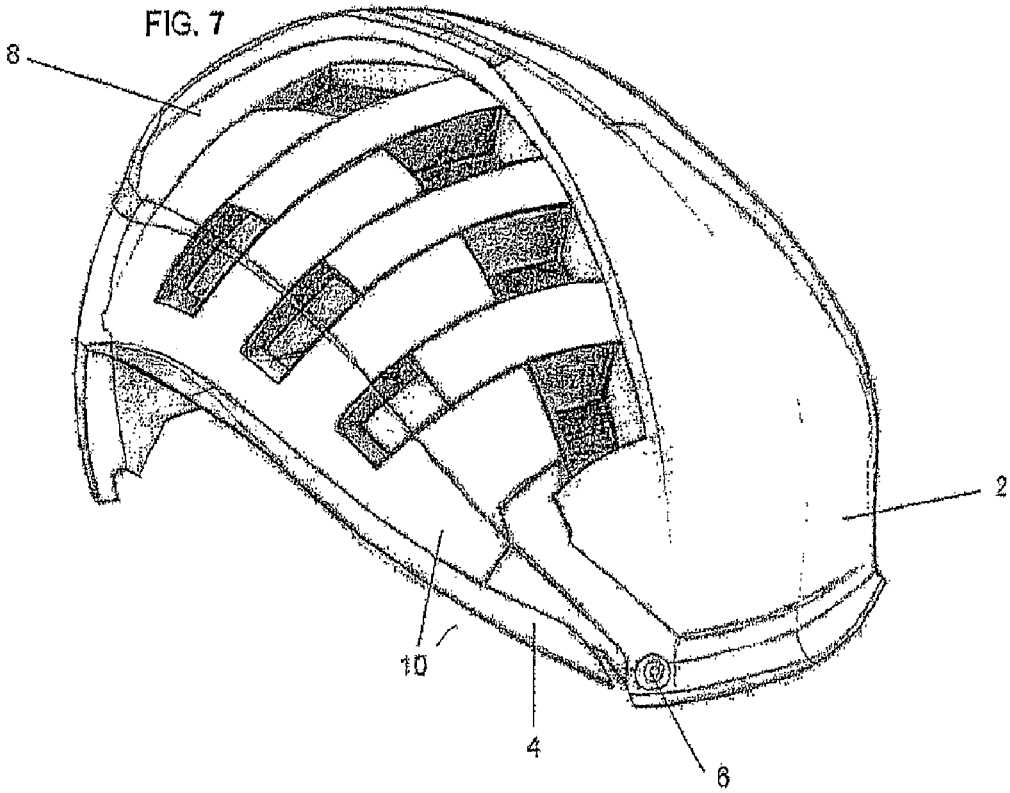

The two elytra (3) and (4) are articulated on the rear end of the crown (2) at articulation points (6) as can be seen in FIG. 2 and in FIGS. 6 and 7.

These articulation points are sufficiently mechanically strong to allow rotation of elytra (3) and (4) relative to these points only, notwithstanding the relative overhang caused by virtue of their relative length.

More precisely, these rotation points (6) allow the elytra (3) and (4) to slide into the crown (2), as can be seen more particularly in FIG. 7. More precisely, the articulation points are oriented so that the elytra move substantially parallel to the bottom of the crown (2).

According to a first embodiment, the occipital flap (5) is articulated on crown (2). In this configuration there are several possibilities.

Figure 4:
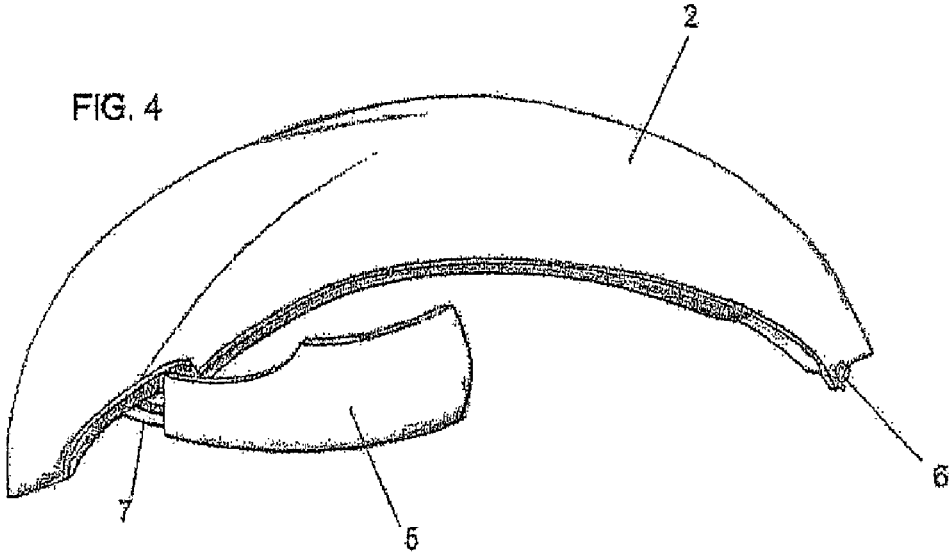
FIG. 4 is a side view of the helmet in accordance with the invention in its folded configuration and FIG. 5 is a bottom view thereof in which one of the elytra is deliberately not shown for the sake of clarity.
Figure 5:
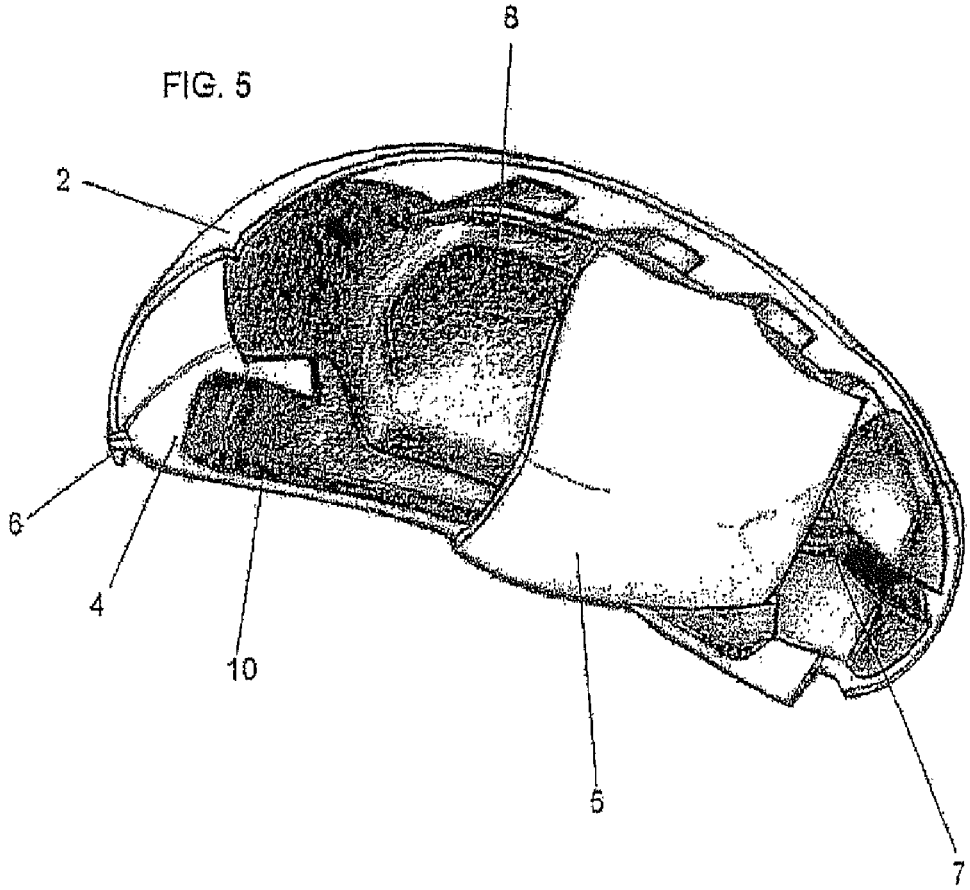

In the first case illustrated in FIGS. 2, 4 and 5, the occipital flap (5) is articulated on the crown by means of a hinge pin (12) provided at the bottom of the crown (see FIG. 2), a hinge (7) extending from the latter and being attached to the inside of said occipital flap.

Figure 10A:
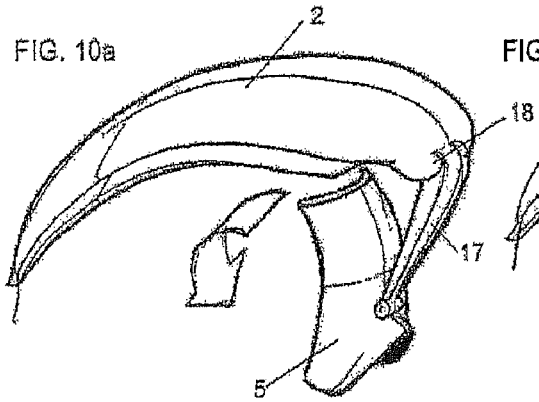
FIGS. 10*a* and 10*b* illustrate another method of articulating the occipital flap on the crown by using a double rotation principle.
Figure 10B:
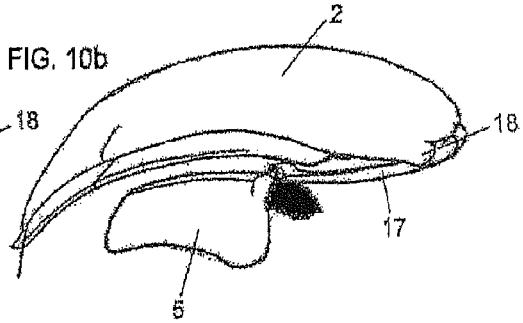

In a second case illustrated in FIGS. 10*a* and 10*b*, articulation of said occipital flap (5) on crown (2) is obtained by means of a hinge (17) rotatably mounted firstly on the external base (18) of said crown and secondly on the external surface of the flap in question. This increases the displacement of the occipital flap (5).

In both these cases, the occipital flap (5) is capable of folding up inside the shell, especially inside the crown.

Figure 9A:
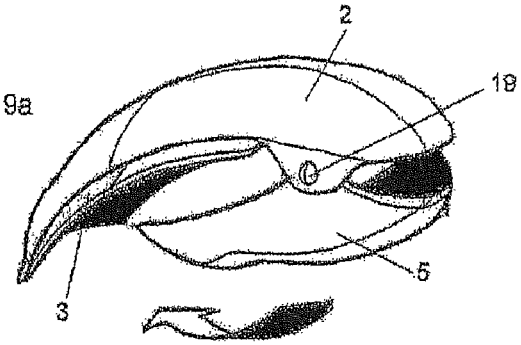
FIGS. 9*a* and 9*b* schematically show two different methods of articulating the occipital flap on the crown.
Figure 9B:
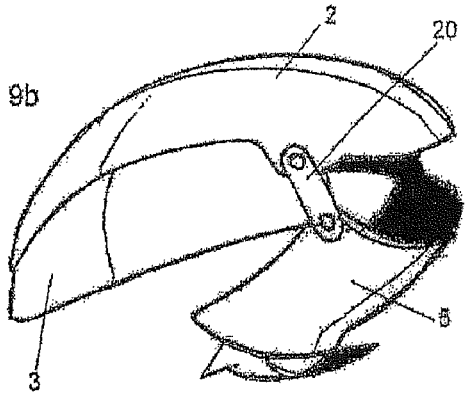

In other cases illustrated in FIGS. 9*a* and 9*b*, the occipital flap (5) is articulated laterally on crown (2) either directly (FIG. 9*a*) by means of hinge pins (19) or by means of two intermediate strips (20).

Figure 11:
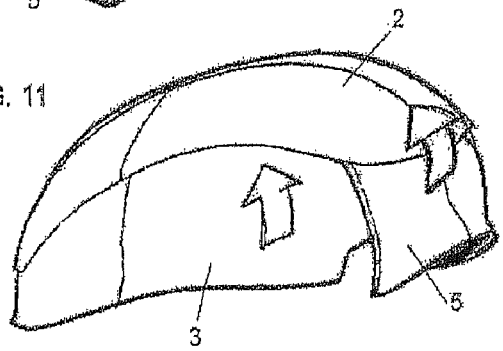
FIG. 11 schematically shows how the occipital flap slides into the space defined between the crown and the shock absorbing element associated with it.

According to a second embodiment of the invention, the occipital flap (5) is capable of sliding between the crown and the shock absorbing element with which it is fitted in the same way as the elytra (3, 4): see FIG. 11. In such a configuration, either the occipital flap has no shock absorbing element or the shock absorbing element with which it is equipped is capable of retracting in the same way, for example, as those described in relation to elytra (3, 4) in relation to FIGS. 8*b* and 8*c*.

When the various flaps are in their deployed position, this defines a substantially continuous, rigid external shell that has a certain mechanical strength that is appropriate to the intended use of such a helmet. Various solutions can be envisaged in order to maintain the helmet thus obtained in its operational deployed position.

According to one simple version that is not shown, the base of the occipital flap (5) is equipped with two male clips each intended to cooperate with an opening made for this purpose in the vicinity of the posterior base of each of the elytra (3, 4).

According to the invention, the size of the helmet is advantageously adjusted by means of a system that is familiar to those skilled in the art and traditionally referred to as a "fit system".

Such a system is either internal or external and in the particular application of the invention is located on the occipital flap (5). In this configuration, it influences the flexibility of the flaps that make up the shell and the ability of the occipital flap (5) to pivot against the user's occiput in order to allow size adjustment.

According to a more sophisticated version in which such a fit system is used, cohesion of said helmet and, in particular, maintaining it in its deployed configuration are achieved by means of said system.

Figure 13A:
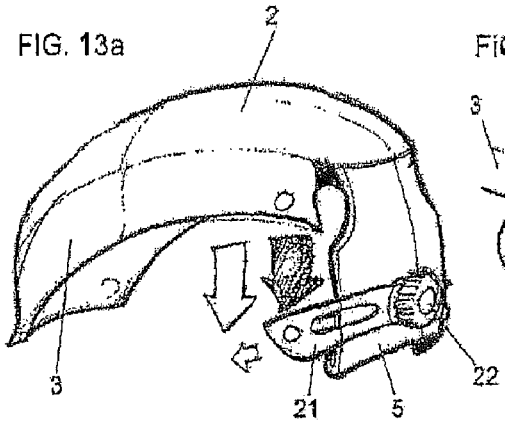
FIGS. 13*a*, 13*b* and 13*c* show implementation of the external fit system with two different methods of clip fastening.
Figure 13B:
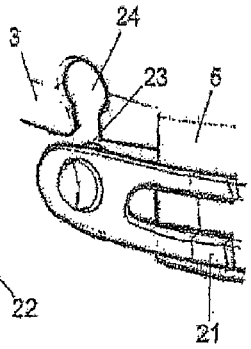
Figure 13C:
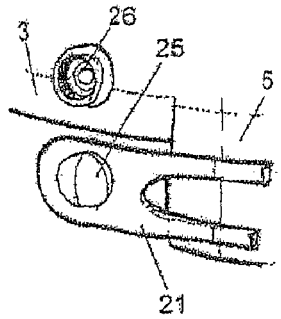

Thus, according to a first version illustrated in FIGS. 13*a*, 13*b* and 13*c*, the end of the lateral tabs (21) originating from said fit system, symbolically represented by thumbwheel (22), are each fitted either with a protruding stud (23) that points towards the inside of the helmet and is capable of cooperating with a slot (24) made for this purpose on the posterior base of the elytron in question (FIG. 13*b*) or a clip (25) intended to cooperate with a matching element (26), also located on the posterior base of said elytron (FIG. 13*c*).

Figure 14A:
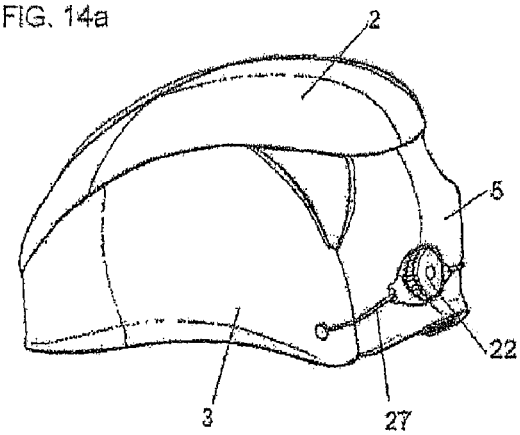
FIGS. 14*a* and 14*b* show another method of implementing the external fit system.
Figure 14B:
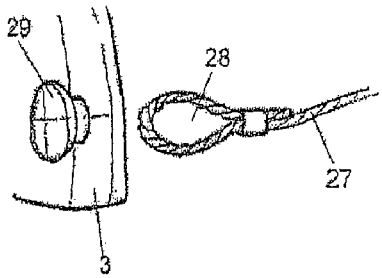

According to a second version illustrated in FIGS. 14*a* and 14*b*, the fit system (22) is equipped with a cord (27), each end of which has a loop (28) intended to encompass a knob (29) provided for this purpose on the posterior base of the elytron in question. This being so, tension exerted on cord (27) through thumbwheel (22) of the fit system causes, besides tightening of the base of the helmet in order to allow the size of the latter to be adjusted, said elytra to be maintained in their deployed position.

Figure 15A:
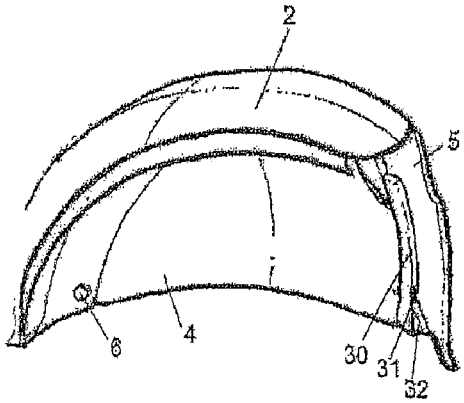
FIGS. 15*a*, 15*b* and 15*c* show another method of adjusting the helmet size.
Figure 15B:
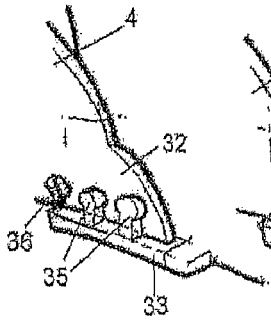
Figure 15C:
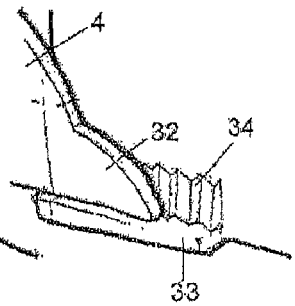

According to another even more sophisticated version illustrated in FIGS. 15*a*, 15*b* and 15*c*, each of the elytra (3, 4) is guided during the process of sliding inside crown (2) by means of a rail (30) made on the internal wall of the occipital flap (5). The lower area of the rail (30) is slit (31) in order to allow movement through slit (31) of the posterior end (32) of the elytron.

This end (32) is accommodated on a limit stop (33) oriented substantially at right angles to rail (30) and on which it is capable of moving besides being guided by slit (31) so that it can cooperate with means of adjusting the size of the helmet such as, for instance, means consisting of a rack (34) or studs (35) that cooperate with matching slots (36), these means being obtained by moulding.

Figure 16A:
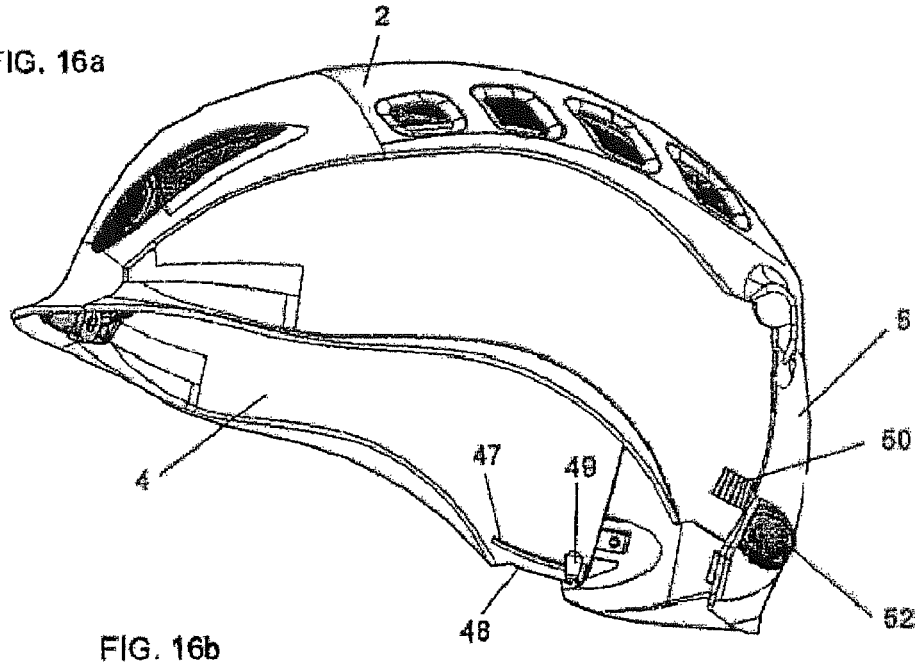
FIGS. 16*a*, 16*b* and 16*c* illustrate implementation of the fit system according to another embodiment of the invention and FIGS. 16*b* and 16*c* provide a detail view of the elements in FIG. 16*a*.
Figure 16B:
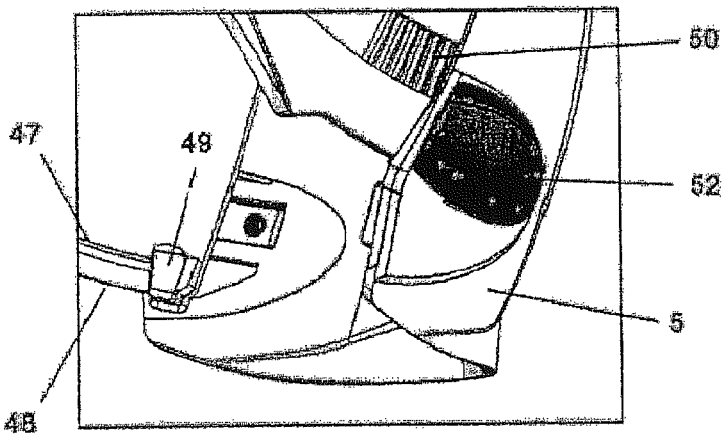
Figure 16C:
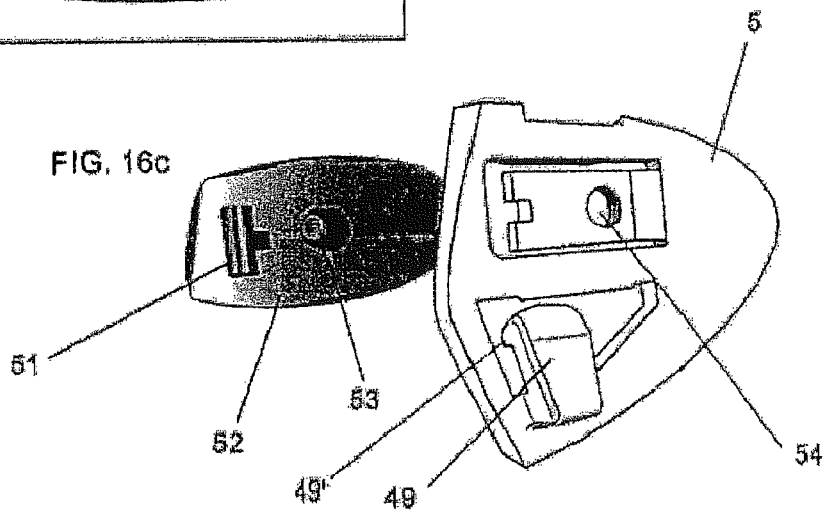

According to yet another version shown in relation to FIGS. 16*a*, 16*b* and 16*c*, when elytron (4) is deployed and in order to give the helmet cohesion, its internal surface has a protruding groove (47) which extends substantially parallel relative to its lower edge (48) and is designed to cooperate with a limit stop (49) which is itself made on the internal surface of occipital element (5). Thus, when the elytron in question is deployed to its full extent, said groove (47) snaps into limit stop (49) with the latter defining an opening provided for this purpose by means of a prong (49') (see FIG. 16 c).

Also, the external surface of the elytron has, slightly above its lower edge, a rack (50) obtained by moulding in particular. [_] When groove (47) is snapped into limit stop (49), this rack (50) is located vertically above a prong (51) which has a matching shape and orientation and is an integral part of a pushbutton type control (52) which can be actuated from the external surface of occipital element (5) and exerts pressure inwardly on the helmet.

Thus, in its original position, i.e. when the elytron is fully deployed, said prong (51) naturally engages in the first notch of the rack. In order to ensure tightening of the helmet, the flexibility of the materials of which it is made is exploited by moving the rack until it faces prong (51), said movement being guided by groove (47) cooperating with limit stop (49).

At the same time, release of the elytron from the occipital element is obtained by simply pressing pushbutton (52) which makes it possible to disengage prong (51) from rack (50) and prong (49') from limit stop (49) in order to disengage the limit stop from groove (47).

Thus, as is apparent in FIG. 16*c*, pushbutton (52) equipped with prong (51) snaps into a recess provided for this purpose in the external surface of occipital element (5) and is fixed here simply by the stud (53) which cooperates with an opening (54) provided for this purpose.

In a version which is even more sophisticated than the previous version, pushbutton (52) can be replaced by a ratchet which makes it possible to ensure firmer tightening of the helmet on the user's head.

Figure 12:
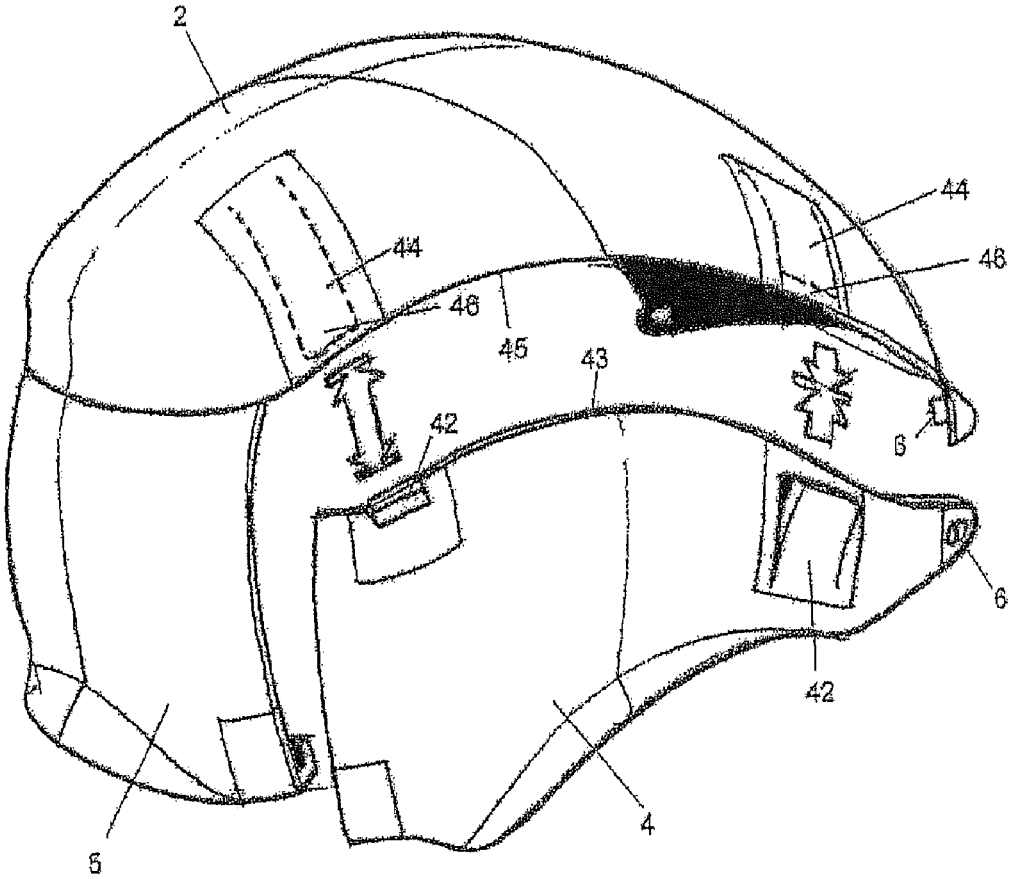
FIG. 12 schematically shows the limitation imposed on deploying the elytra in order to achieve conformation of the helmet in its operational deployed mode.

It is apparent that limit stop (49) has a dual function:

it limits deployment of the elytron, if applicable by cooperating with devices (42, 44, 46) (see FIG. 12 and explanations relating thereto below);

it adjusts the size of the helmet in cooperation with the occipital element.

According to another aspect of the invention, each of the flaps that make up this shell accommodates one or more shock absorbing elements that act as an internal shock absorbing liner.

These elements of the internal shock absorbing liner are made of one or more semi-rigid cellular materials chosen depending on their ability to absorb compressive shocks, the applicable standards concerning the activity in question and their flexibility enabling them to match themselves to the shape of the user's cranium as closely as possible.

This material generally consists of a polymer foam such as polypropylenes, polystyrenes or expanded polyurethane.

These elements have a typical thickness of 10 to 35 mm and a density of 60 g/l to 100 g/l.

The shock absorbing properties of the polypropylene foam are accompanied by a memory effect that enables said elements to return to their initial shape after deformation caused by a low-energy impact. This gives the helmet improved strength and durability.

Crown (2) accommodates a shock absorbing element (8) made by means of one of the above-mentioned materials. This element (8) is attached by bonding it to the bottom of the inside of crown (2) only in the latter's central area.

According to a first configuration more particularly shown in FIGS. 2, 3, 5, 6 and 7, this element (8) has the distinctive feature of forming, at the level of these two lateral extensions, i.e. either side of the central area that is substantially straight, notches (13) that are substantially parallel to each other and extend towards the base of the helmet when the latter is in its operational configuration.

Figure 3:
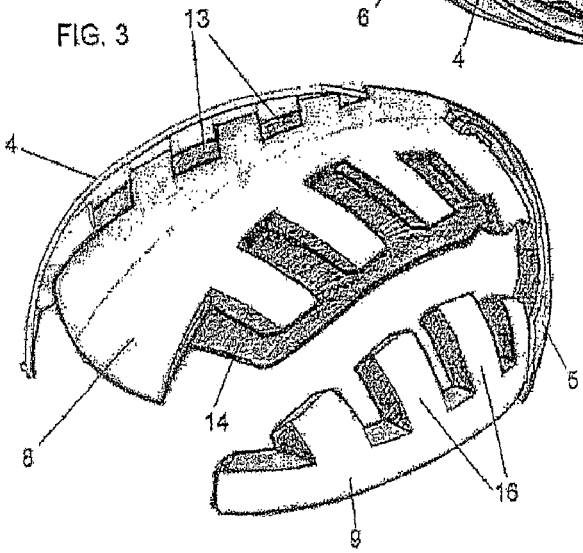
FIG. 3 is substantially a perspective top view, in which firstly the crown and secondly one of the elytra are deliberately not shown for the sake of clarity.

These are not through-notches, as can be seen in FIGS. 3 and 6. The recess that defines said notches actually extends from a thinned area (14), intended to come into contact with the user's cranium, towards the outside.

In addition, the internal shock absorbing element (8) is only attached to the crown by its anterior and posterior ends so as to define, together with the crown, an empty space capable of accommodating, as described below, the two elytra (3) and (4)

Consequently, the deformable internal element, (9) and (10) respectively, associated with each of the elytra (3) and (4) comprises, in this configuration, firstly a substantially linear part that is attached to the internal base of the elytron in question from which a plurality of protrusions (16) extend upwards, their number and shape matching those of the notches (13) made in the internal shock absorbing element (8) associated with the crown (2).

These particular features are clearly visible in FIGS. 6 and 7.

This being so, when an elytron (3) or (4) pivots relative to rotation point (6) or when said elytron simply makes a translational movement (in the absence of any rotation point), the actual elytron is capable of penetrating into the space defined between shock absorbing element (8) associated with crown (2) and the latter, this relative displacement not being prevented by the presence of respective shock absorbing elements (9, 10) of elytra (3, 4) as protrusions (16) of the latter slide into the notches (13).

In its operational position (see FIG. 6 in particular), it is apparent that the gaps in the shock absorbing elements (9, 10) associated with elytra (3, 4) do not affect the shock absorbing nature of the liner thus designed.

In fact, although the elements of the internal liner are not absolutely continuous, the surface area of said elements that is capable of coming into contact with the user's cranium remains large and sufficient in every case to enable the liner resulting from the use of the various shock absorbing elements to fulfil its function of absorbing shocks and, consequently, affording protection.

Figure 8A:
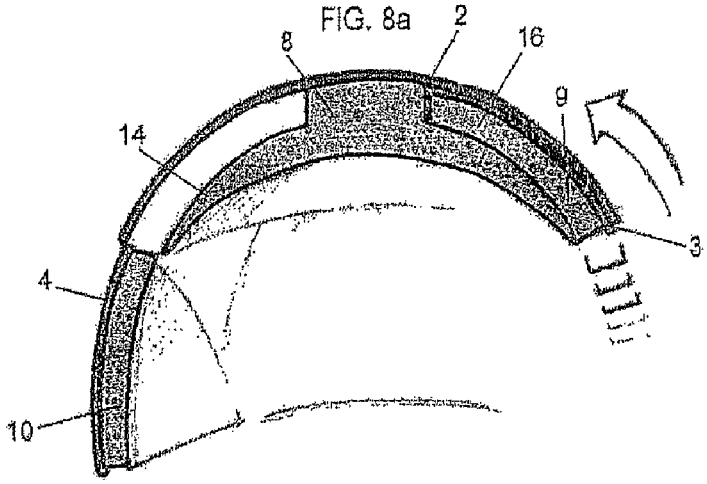
FIGS. 8*a*, 8*b* and 8*c* schematically show three different methods of retracting the shock absorbing elements into the helmet.

According to another configuration of the invention shown in FIG. 8*a* which is a variant of the preceding configuration, shock absorbing element (8) associated with crown (2) does not have notches (13) but creates a substantially uniform continuous empty space between thinned area or base (14) and crown (2) into which the shock absorbing element (9, 10) of elytra (3, 4) is capable of sliding, these elements also being continuous (an thus having no protrusions). The profile of said elements (9, 10) substantially matches that of said empty space. This particular configuration may be required in order to offer degrees of protection that are greater than that obtained by means of the preceding configuration.

Figure 8B:
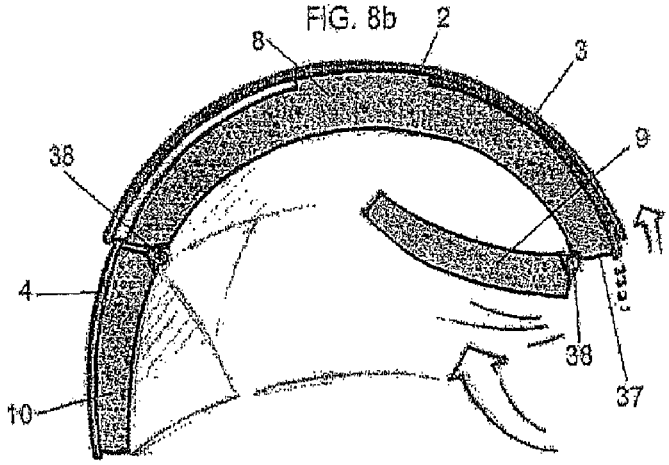

According to another configuration of the invention shown schematically in FIG. 8*b*, the shock absorbing elements (9, 10) associated with elytra (3, 4) have a different appearance. Firstly they are not attached to the elytra in question, not in an irreversible manner in any case. For example, the shock absorbing elements (9, 10) are attached to the elytra, when the latter are in their deployed position, by means of a hook-and-loop tape-type system. Then, shock absorbing elements (9, 10) are each articulated on the shock absorbing elements (8) associated with crown (2) at a hinge pin (38) located in the vicinity of the free edge (37) of said element (8).

Thus, when one wishes to fold the helmet, it is sufficient to detach the shock absorbing elements (9, 10) from the respective elytra (3, 4) by simply pulling, thereby releasing said elytra and allowing them to slide into the space defined between crown (2) and shock absorbing element (8) associated with it. Consequently, shock absorbing elements (9, 10) are folded up inside the helmet by simple rotation around hinge pin (38) on shock absorbing element (8) of the crown.

Figure 8C:
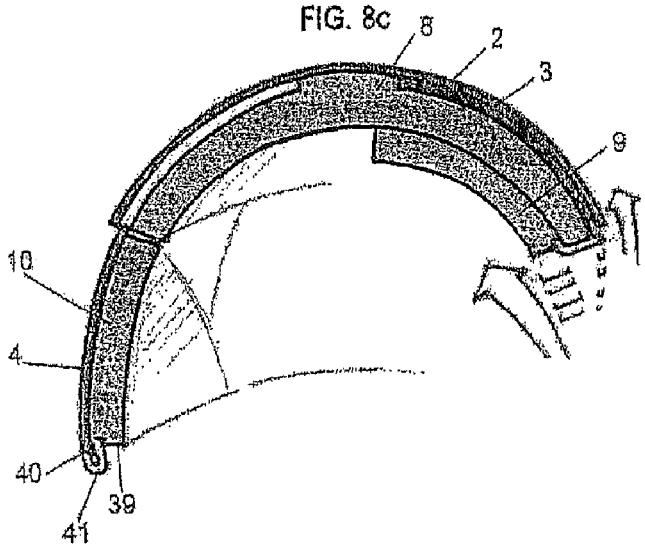

According to another configuration of a similar kind illustrated in particular in FIG. 8*c*, the shock absorbing elements (9, 10) associated with each of the elytra (3, 4) are also reversibly attached to the internal wall of said elytra in the deployed position, once again, for example, by means of a hook-and-loop tape-type system, but, in addition, the lower edge (39) of said shock absorbing elements (9, 10) is attached to the lower edge (40) of the elytron in question by means of a flexible hinge (41).

This being so, when one wishes to fold the helmet, one detaches the shock absorbing elements (9, 10) from the respective elytra (3, 4), thereby firstly allowing the elytra to slide into the space defined between crown (2) and the shock absorbing element (8) associated with it. At the same time, because of the presence of flexible hinge (41), this sliding causes displacement of shock absorbing elements (9, 10) that are associated with them respectively substantially parallel to shock absorbing element (8) of crown (2).

Advantageously, the occipital flap (5) may also be fitted with an internal shock absorbing element (11). This provides both comfort as well as shock absorption.

The helmet in accordance with the invention may also comprise means of limiting movement to deploy the elytra. These means may, for instance, consist of limits stops (42) obtained by moulding made in the vicinity of the upper edge (43) of each of the elytra (3, 4) and protruding relative to their external surface. These limits stops are intended to be accommodated in a linear feature (44) provided for this purpose on the internal surface of crown (2) that is thus capable of acting as a guide as the elytra slide out.

The end of said linear features (44) close to the lower edge (45) of crown (2) defines a larger receptacle (46) that substantially matches that of limit stop (42). This being so, when the latter reaches said volume (46) it is locked in position, thereby limiting deployment of the elytron in question.

This deployment can also be limited by using limit stop (49) which cooperates with protruding groove (47) on the internal surface of each of elytra (3, 4) (cf. above and FIGS. 16*a*, 16*b*, 16*c*).

Figure 17:
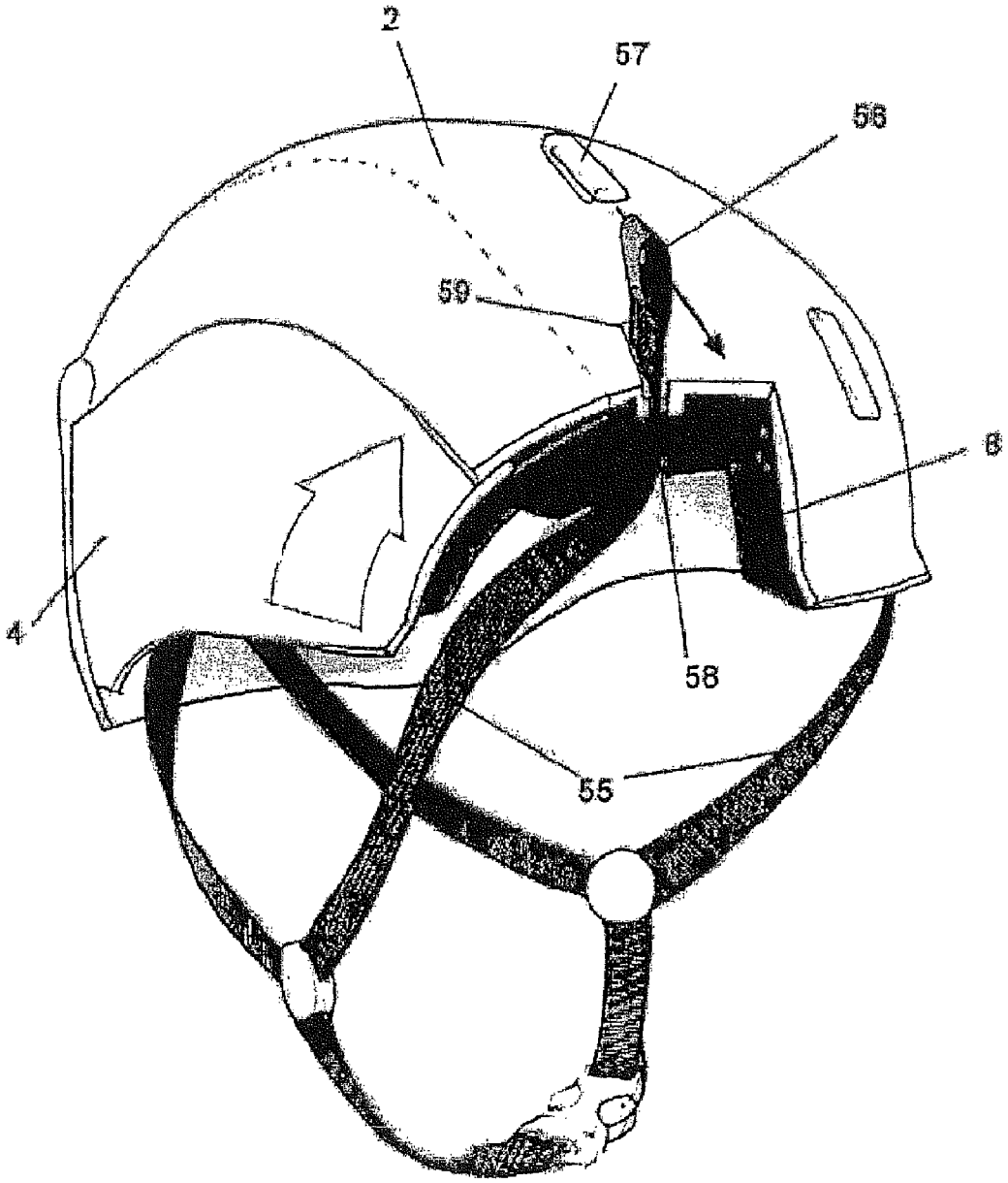
FIG. 17 is a schematic view of a first method of fastening the anterior attachment straps of the helmet to the user's head.

According to the invention, the helmet thus designed is also fitted with attachment straps, more especially described in relation to FIGS. 17 to 19, which make it possible to reversibly attach it to the user's head.

In the simplest version shown in FIG. 17, anterior straps (55) are attached to crown (2) by means of loop (56) which encompasses a device (57) provided for this purpose, said straps passing through the corresponding shock absorbing liner (8) and said crown (2) via slits (58) and (59) respectively which are made for this purpose.

Figure 18A:
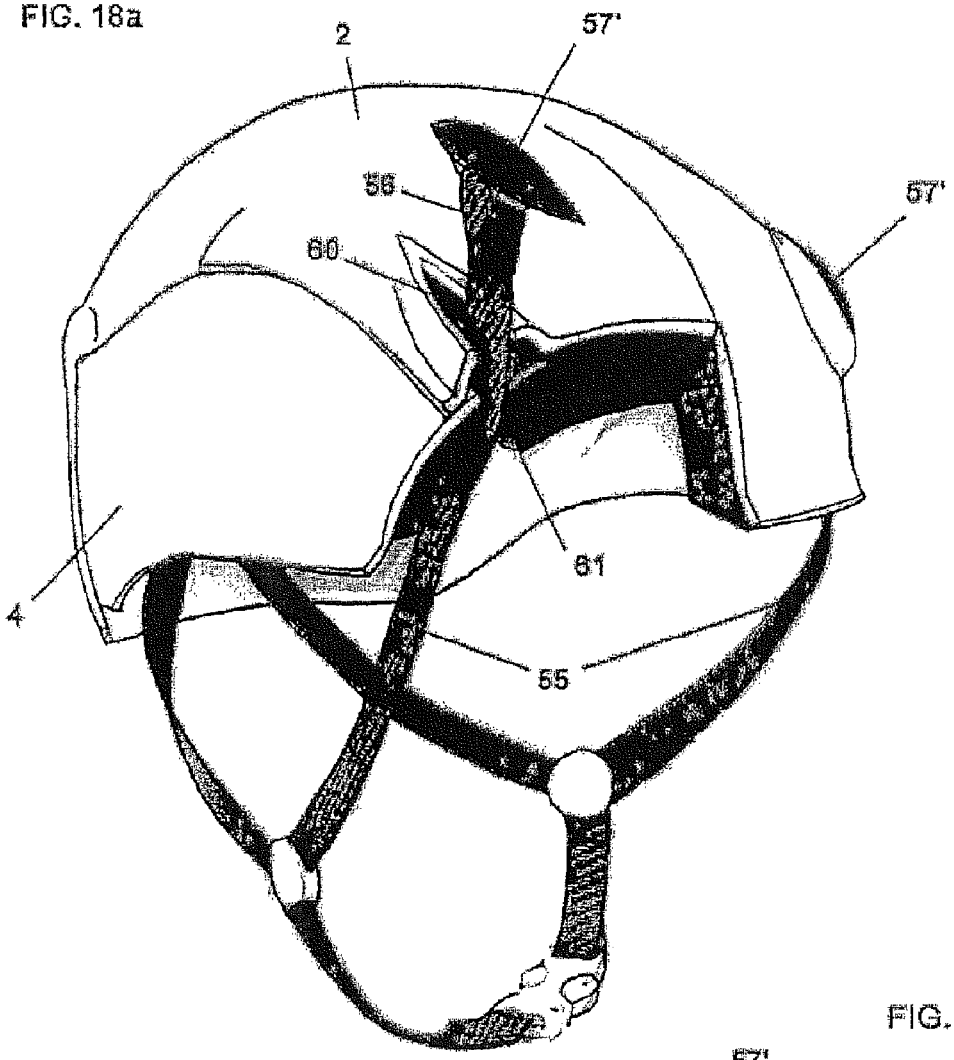
FIGS. 18*a* and 18*b* are schematic views of a second method of fastening the anterior attachment straps of the helmet to the user's head.
Figure 18B:
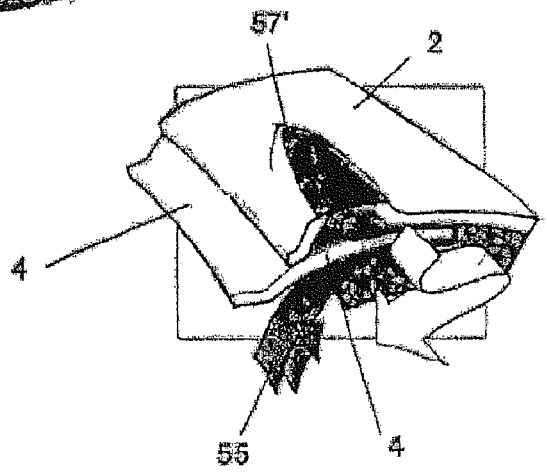

In a more advanced version, described more especially in relation to FIGS. 18*a* and 18*b*, each of the loops (56) of the two anterior straps (55) wrap around a device (57') which is also located on the external surface of crown (2). However, in this configuration, said crown comprises two devices (57') located more laterally on the crown rather than in a relatively centred position, as in the previous case.

In addition, vertically above these devices (57'), there is a slit (60) in the crown and a slit (61) in the corresponding shock absorbing liner. Thus, when the elytra are folded up inwardly into the helmet, they cause folding of anterior straps (55) (cf. FIG. 18*b*), thereby shortening them. This prevents said straps hanging too much when the helmet is not in use. In addition, this prevents inappropriate use of the helmet, i.e. use with the elytra not deployed which would reduce the protection provided by the helmet. It is apparent that, in fact, in order to obtain looping of the attachment straps, pulling on them necessarily causes deployment of the elytra since slits (60, 61) are located so that pulling the straps in order to loop them causes the elytra to be deployed to their maximum extent.

According to another version which is based on the same principle and described in relation to FIGS. 19*a*, 19*b* and 19*c*, the loop (56) of each of the anterior straps (55) is wrapped round a device (62) made on the upper edge (43) of the elytra. There is a bump (63) in the crown in order to allow folding of the elytron fitted with this device between liner (8) and crown (2).

This being so, once again, as soon as the elytra are folded up, they cause shortening of anterior straps (55) with the same consequences as those stated earlier in relation to the version described above.

When one wants to reduce the dimensions of the helmet, i.e. when it is not in use, one firstly slides the elytra (3, 4) into the space defined between shock absorbing element (8) and crown (2) by rotating said elytra relative to their respective articulation point (6) or even by guiding on rail (30), then one folds the occipital flap up inside the crown by rotating the latter.

In this way one obtains especially compact overall dimensions (see FIGS. 4 and 5) that are particularly suitable to allow storage of said helmet in a lightweight bag of the kind frequently used by those who indulge in the sports in question or by cyclists who use their bicycle as a means of transport, particularly in urban areas.

The attractiveness of the invention is readily apparent, firstly, because of the compact size of the helmet thus obtained in its non-operational configuration (folded) as well as its especially light weight and, secondly, because of the ease with which said helmet can be switched between its two possible configurations.

Moreover, such a helmet fulfils the traditional functions of providing protection and absorbing shocks in the event of impact that are expected of it.

The invention claimed is:

1. A protective helmet comprising a rigid or semi-rigid external shell comprising a plurality of rigid or semi-rigid flaps joined together, a compressively deformable internal liner acting as a shock absorber, the shock absorber comprising several elements associated with said flaps, including at least one central element and one or more peripheral elements, wherein at least some of the flaps that constitute the external shell are capable of moving relative to each other at the level of their respective means of connection, wherein only the peripheral elements that constitute the internal liner associated with the corresponding flaps are designed so that they retract inside the volume defined by the helmet and by said central element during relative displacement of the corresponding flaps, wherein a crown flap of the rigid or semi-rigid flaps is disposed at an upper extent of the rigid or semi-rigid flaps relative to the other flaps of the rigid or semi-rigid flaps, the central element being directly connected to the crown flap, and wherein the shock absorbing element associated with the crown has lateral extensions pointing towards the base of the helmet and define, at the level of said extensions, a plurality of notches oriented substantially parallel to each other into which protrusions of matching shape and corresponding number constituting part of the shock absorbing element associated with each elytron are capable of sliding or engaging.

2. A protective helmet as claimed in claim 1, wherein the rigid or semi-rigid external shell comprises an upper flap defining a crown and two lateral flaps or elytra that are articulated on the crown.

3. A protective helmet as claimed in claim 2, wherein the helmet comprises, on its external shell, a posterior or occipital flap that is articulated directly or indirectly on the crown and can be folded up inside the latter, said flap comprising a shock absorbing element capable of both providing comfort and absorbing shocks.

4. A protective helmet as claimed in claim 3, wherein the helmet is fitted with a means of adjusting its size comprising a fit system separately mounted on the internal or external surface of the occipital flap and making this adjustment by influencing the flexibility of the external shell and the ability of the occipital flap to rotate.

5. A protective helmet as claimed in claim 4, wherein an end of each lateral tab with which the fit system is equipped is each fitted with either a protruding stud that points towards the inside of the helmet and is capable of cooperating with a slot on the posterior base of the elytron in question or a clip intended to cooperate with a matching element, also located on the posterior base of said elytron.

6. A protective helmet as claimed in claim 4, wherein the fit system is equipped with a cord, each end of which has a loop intended to encompass a knob provided for this purpose on the posterior base of the elytron and the pulling of which causes, besides tightening of the base of the helmet in order to allow adjustment of the size of the latter, said elytra to be maintained in their deployed position.

7. A protective helmet as claimed in claim 4, wherein the fit system consists of a pushbutton mounted on the external surface of occipital flap and equipped with a prong intended to cooperate with a rack on the external surface of the elytra, said rack being maintained by the action of said prong of the pushbutton due to guidance resulting from the cooperation of the groove with the limit stop.

8. A protective helmet as claimed in claim 3, wherein each of the elytra is guided during the process of sliding inside the crown by means of a rail made on the internal wall of the occipital flap.

9. A protective helmet as claimed in claim 8, wherein the lower area of the rail is split in order to allow movement through the slit of a posterior end of the elytron, said end being capable of moving and being guided by said slit in order to cooperate with means of adjusting the size of the helmet.

10. A protective helmet as claimed in claim 3, wherein the helmet comprises means of limiting the deploying movement of the elytra comprising:

a limit stop on the internal surface of occipital flap;

a protruding groove on the internal surface of each of the elytra which extends substantially parallel relative to their lower edge and is intended to cooperate with said limit stop.

11. A protective helmet as claimed in claim 2, wherein the elytra are each articulated in the anterior or posterior area of the crown relative to an articulation point.

12. A protective helmet as claimed in claim 11, wherein the shock absorbing element associated with the crown defines, together with the latter, an empty space within which the elytra are capable of sliding by rotating around their respective point where the elytra are articulated on the crown or by making a simple translational movement towards the crown.

13. A protective helmet as claimed in claim 2, wherein the helmet is equipped with straps to attach it to the user's head, with anterior straps being fastened to the crown by means of a loop which wraps around a device provided for this purpose, said straps passing through the shock absorbing element associated with the crown and through the crown via slits and, respectively, made for this purpose.

14. A protective helmet as claimed in claim 13, wherein each of the loops of the anterior straps wraps around a device located laterally on the latter and vertically above which there is a slit in the crown and a slit in the corresponding liner.

15. A protective helmet as claimed in claim 2, wherein the shock absorbing element associated with the crown defines a substantially uniform and continuous empty space between its base, intended to come into contact with the user's cranium and said crown, and the shock absorbing element associated with each elytron has a continuous section that matches said space and is capable of sliding into this space.

16. A protective helmet as claimed in claim 2, wherein the helmet comprises, on its external shell, a posterior or occipital flap capable of sliding into the space defined by the crown and the shock absorbing element associated with the crown.

17. A protective helmet as claimed in claim 2, wherein the helmet comprises means of limiting the movement of deploying the elytra comprising limit stops in the vicinity of the upper edge of each of the elytra forming a protrusion relative to their external surface, each of said limit stops being intended to cooperate with a linear feature provided for this purpose on the internal surface of the crown, that is thus capable of acting as a guide during sliding of the elytra, the end of said linear features in the vicinity of the lower edge of the crown defining a receptacle that substantially matches that of limit stop.

18. A protective helmet as claimed in claim 2, wherein the helmet is equipped with straps to attach it to the user's head, with anterior straps being fastened to the elytra by means of a loop which wraps around a device on an upper edge of the elytra and in that the crown comprises bumps in order to allow folding of the flap in question between the shock absorbing element associated with the crown and the crown.

19. A protective helmet as claimed in claim 1, wherein the rigid or semi-rigid external shell comprises an upper flap defining a crown and two lateral flaps or elytra that are capable of sliding towards the bottom of the crown by making a simple translational movement.

20. A protective helmet as claimed in claim 1, wherein the shock absorbing elements associated with the elytra are not irreversibly attached to the latter and are each articulated on the shock absorbing element associated with the crown on a hinge pin in the vicinity of the free edge of said shock absorbing element so that they can be folded up inside the helmet when elytra slide into the space defined by the crown and said shock absorbing element associated with the crown.

21. A protective helmet as claimed in claim 1, wherein the shock absorbing elements associated with the elytra are not irreversibly attached to the latter and their lower edge is connected to the lower edge of the corresponding elytron by means of a flexible hinge so that they slide simultaneously into the shock absorbing element of the crown when the corresponding elytron slides into the space defined by the crown and the shock absorbing element associated with the crown.

* * * * *